United States Patent [19]

Kumakura et al.

[11] Patent Number: 4,912,000

[45] Date of Patent: Mar. 27, 1990

[54] ELECTROPHOTOGRAPHIC PHOTORECEPTOR

[75] Inventors: Minoru Kumakura, Maebashi; Isao Kaetsu, Takasaki; Masahiro Horigome; Tsuneo Isomura, both of Yamanashi; Tomio Yoneyama; Tadaichi Murata, both of Kofu, all of Japan

[73] Assignees: Japan Atomic Energy Research Institute; Shindengen Electric Manufacturing Co.; Yamanashi Electronics Co., Ltd., all of Tokyo, Japan

[21] Appl. No.: 302,931

[22] Filed: Jan. 30, 1989

[30] Foreign Application Priority Data

Feb. 5, 1988 [JP] Japan ..... 63-25491

[51] Int. Cl.[4] ..... G03G 5/14

[52] U.S. Cl. ..... 430/67; 430/66; 528/38

[58] Field of Search ..... 430/66, 67

[56] References Cited

FOREIGN PATENT DOCUMENTS

| | | | |
|---|---|---|---|
| 55-2237 | 1/1980 | Japan | 430/66 |
| 55-95953 | 7/1980 | Japan | 430/67 |
| 56-109360 | 8/1981 | Japan | 430/66 |
| 56-117247 | 9/1981 | Japan | 430/67 |
| 57-35457 | 7/1982 | Japan . | |
| 58-3223 | 1/1983 | Japan . | |
| 58-102944 | 6/1983 | Japan | 430/67 |

*Primary Examiner*—Roland E. Martin

*Attorney, Agent, or Firm*—Stevens, Davis, Miller & Mosher

[57] ABSTRACT

An electrophotographic photoreceptor comprises an electrically conductive support, a photoconductive layer provided thereon, and a protective layer coated on the photoconductive layer, wherein the protective layer comprises a product of uncatalized hydrolysis of a composition essentially consisting of at least one specific epoxysilane compound, at least one specific alkylalkoxysilane compound, and at least one specific aminosilane compound. The photoreceptor is very useful in that it is free from wear due to friction with paper and cleaning members, keeps high resolving power, and is sufficiently proof against continuous copying under conditions of high temperature and high humidity.

5 Claims, No Drawings

ELECTROPHOTOGRAPHIC PHOTORECEPTOR

FIELD OF THE INVENTION AND RELATED ART STATEMENT

1. Field of the Invention

The present invention relates to an electrophotographic photoreceptor, and, more particularly, it relates to an electrophotographic photoreceptor which is excellent in endurance.

2. Related Art

Recently, because of spread of office copies and development of information recording devices, a wide application and a future development of electrophotographic technique are expected. Inorganic photosensitive materials such as selenium, zinc oxide, cadmium sulfide, and amorphous silicon have been used in photoconductive layers of electrophotographic photoreceptors for a long time, and, recently, organic photoreceptor using organometal complexes or organic pigments have been developed and put to practical use. These materials, however, have a defect of wear resistance in that the surface of the photoreceptors using these materials is marred by development with toners and friction with paper and cleaning members. In order to eliminate this defect it has been proposed to provide transparent protective layers on the photoconductive layer to improve the endurance thereof. Examples of the materials which can be used for forming protective layers include polymer materials such as polyurethane, polyester, polycarbonate, and polyethylene.

Also, hydrolyzates of silane coupling agents have been reported as materials for transparent protective layers. At least one of silane compounds such as methyltrimethoxysilane, vinyltriethoxysilane, γ-glycidoxypropyltrimethoxysilane, γ-aminopropyltrimethoxysilane, and tetraethoxysilane is hydrolyzed in the presence of an acid or alkali catalyst and applied to a photoconductive layer, and dried to form a protective layer.

However, the materials such as those mentioned above cannot be said to have sufficient endurance. In particular, photoreceptors provided with transparent protective layers of such materials have defects in that changes of temperature and humidity are reflected in the quality of images such that clear and stable images cannot be obtained.

Also, in the case of using the hydrolyzates for the formation of protective layers, it is usual to allow hydrolysis to proceed in the presence of a catalyst as described above. The use of a catalyst has a disadvantage in that the resistivity of the resulting protective layer decreases and clear images cannot be obtained because the undesirable spread of image occur under conditions of high temperature and high humidity. In addition, it has been a problem to be solved that, when the above-described silane coupling agents are hydrolyzed in the absence of a catalyst protective layers having sufficiently high hardness cannot be obtained. Although it is possible to obtain a protective layer having sufficiently high hardness by allowing the hydrolysis to proceed in the absence of a catalyst and performing the curing at relatively high temperature (about 100° C.), in that case, for example, with selenium photoreceptors, the crystallization of selenium is promoted so much that the performance of the photoreceptors is lowered. Therefore, it is also important to control the curing temperature of the protective layers in order to maintain the performance of the photoreceptors. In any event, there have been difficult problems, in the art, in developing a protective layer more suitable for an electrophotographic photoreceptor.

OBJECT AND SUMMARY OF THE INVENTION

It is an object of the present invention to provide an electrophotographic photoreceptor provided with a protective layer which is free from the above-noted defects and problems and which has a particularly excellent wear resistance, effective heat and humidity resistance, and is capable of forming stable images without fail.

As a result of an extensive study of improving the surface strength of photoreceptors it has been found that it is possible to much farther improve the surface strength than conventional without deteriorating electric properties, by preparing a composition to be a specific mixture using characteristic silane compounds (silane coupling agents) in a certain mix proportion, subjecting the composition to uncatalyzed hydrolysis, coating the composition comprising the products of uncatalized hydrolysis on a photoreceptor, and curing the coating at relatively low temperature. The present invention has thus been accomplished.

The present invention provides an electrophotographic photoreceptor comprising an electrically conductive support, a photoconductive layer provided thereon, and a protective layer coated on the photoconductive layer, wherein the protective layer comprises a product of uncatalyzed hydrolysis of a composition essentially consisting of:

a. at least one epoxysilane compound selected from the following group A;
b. at least one alkylalkoxysilane compound selected from the following group B; and
c. at least one aminesilane compound selected from the following group C.

Group A;

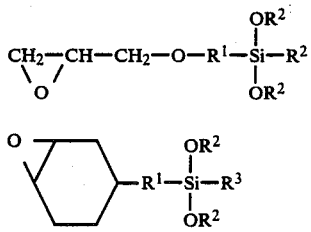

Group B; $(R^4)_nSi(OR^4)_{4-n}$

Group C;

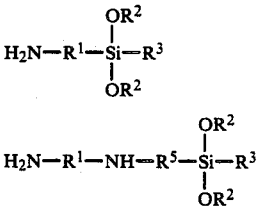

wherein $R^1$ represents a straight-chain or branched alkyl group having up to 6 carbon atoms or $—CH_2CH=CH—CH_2CH_2—$, $R^2$ represents a straight-chain or branched alkyl group having up to 4 carbon atoms, $R^3$ represents a straight-chain or branched alkyl group having up to 4 carbon atoms or $OR^{3'}$, $R^{3'}$represents a straight-chain or branched alkyl group having up to 4 carbon atoms, $R^4$ represents a straight-chain or branched alkyl group having up to 8 carbon atoms, $R^5$ represents a straight-chain or branched alkyl group having from 2 to 4 carbon atoms, and n is an integer of up to 3.

DETAILED DESCRIPTION OF THE PREFERRED EMBODIMENT

The support in the photoreceptor of the present invention may be made of a metal such as aluminum, copper and stainless steel or may be a support which is made of an electrical insulating material such as a polymer resin and has a thin layer of a material such as selenium, copper, and palladium. The photoconductive layer provided on the electrically conductive support may be made of an inorganic photoconductive material such as selenium, a selenium-tellerium compound, a selenium-arsenic compound, cadmium sulfide, zinc oxide, and amorphous silicon or an organic photoconductive material.

For the charge-generating layer of the organic photoconductive layer may be used an organic pigment such as a metal-containing phthalocyanine and an azo dye. Between the charge-generating layer and the support there may be provided a barrier layer made of a metal oxide such as aluminum oxide or a polymer material such as polyurethane and cellulose. The charge-transfer layer may be made of a polymer material such as poly(N-vinylcarbazole) and polyvinylidene chloride, a hydrazone derivative and an oxazole derivative. These materials used for forming the charge-transfer layer may be made composite with poly(methyl methacrylate), polycarbonate, and polyester.

The protective layer consisting essential of hydrolyzates of silane compounds is formed on the photoconductive layer, for example, by dipping, spin-coating, spraying or Langmuir-Blodgett method. The protective layer is transparent and wear-resistant.

The composition essentially consisting of the silane compounds used for forming the protective layer is heat-curable. Examples of the silane compounds and their mix proportions are as set forth below.

Examples of the silane compounds represented by the above-described formulas include, for group A, β-(3,4-epoxycyclohexyl)ethylmethoxy-silane, β-glycidoxyethylpropyldipropoxysilane, γ-glycidoxyethylpropylbutoxysilane, γ-glycidoxypropyltrimethoxysilane, γ-glycidoxypropyltriethoxysilane, γ-glycidoxyethylpropyldimethoxysilane, γ-glycidoxyethylpropyldiethoxysilane, γ-glycidoxyethylpoopyldipropoxysilane, and γ-glycidoxyethylpropyldibutoxysilane, with β-(3,4-epoxycyclohexyl)ethyltrimethoxysilane, γ-glycidoxypropyltrimethoxysilane, γ-glycidoxypropyltriethoxysilane and γ-glycidoxyethylpropyldiethoxysilane particularly being preferably used; for group B, monomethyltrimethoxysilane, dimethyldimethoxysilane, monomethyltriethoxysilane, dimethyldiethoxysilane, monoethyltrimethoxysilane, diethyldimethoxysilane, monoethyltriethoxysilane, diethyldiethoxysilane, trimethylmethoxysilane, tetramethoxysilane, tetraethoxysilane, tetrapropoxysilane, and tetrabutoxysilane, with methyltrimethoxysilane, dimethyldimethoxysilane, trimethylmethoxysilane, and tetramethoxysilane being particularly preferable; and, for group C, aminomethyltrimethoxysilane, aminomethyltriethoxysilane, aminoethyltriethoxysilane, γ-aminopropyltriethoxysilane, aminomethylpropoxysilane, aminopropyltrimethoxysilane, aminopropyltrimethoxysilane, aminopropyltriethoxysilane, aminopropyltributoxysilane, N-β-(aminoethyl)-γ-aminopropyltrimethoxysilane, and N-β-(aminoethyl)-γ-aminopropylmethyldimethoxysilane, with aminomethyltrimethoxysilane, aminoethyltriethoxysilane, γ-aminopropyl triethoxysilane, N-β-(aminoethyl)-γ-aminopropyltrimethoxysilane, and N-β-(aminoethyl)-γ-aminopropylmethyldimethoxysilane being particularly preferably used.

It is preferred that the composition contains from 2 to 10 parts by volume of at least one epoxysilane compound selected from group A, from 2 to 10 parts by volume of at least one alkylalkoxysilane compound selected from group B, from 2 to 10 parts by volume of at least one aminosilane compound selected from group C, and from 1 to 6 parts by volume of water. The composition is prepared by mixing at least one silane compound selected from each of groups A, B, and C. Water is then added to hydrolize the silanes. Immediately after completion of the hydrolysis, an organic solvent such as methanol and ethanol is added to adjust the concentration of the hydrolyzates. Although selecting the above-mentioned silane compounds is important in the present invention, it has also been found as a result of the repeated investigation that the specific mix proportions of the silane compounds and the addition of the organic solvent definitely affect the endurance of the resulting protective layer. The composition containing the above-mentioned preferred silane compounds is characterized in that no catalyst is required for hydrolysis and the hydrolysis proceeds only by adding water and stirring. In addition it suffices that the hydrolysis is carried out for very short period of time. The organic solvent added after the hydrolysis is preferably hydrophilic, and methanol, ethanol, propanol, dioxane, methyl cellosolve, ethyl cellosolve, etc. can be used. The amount added of the organic solvent is preferably from 50 to 300 parts by volume. The resulting solution containing the hydrolyzate and the organic solvent is applied to the photoconductive layer and cured by heating. For curing it is needless to raise the temperature higher than 100° C., and the curing at from 20° to 80° C. for 1 hour or less is possible. The curing at such low temperatures is very advantageous in that, when the photoconductive layer is formed using amorphous selenium, the deterioration of photoconductive performance due to the crystallization of selenium can be prevented. Also, in the present invention, it is not necessary to add, as a catalyst, a known acid such as hydrochloric acid, sulfuric acid, acetic acid, and trifluoroacetic acid, to carry out the hydrolysis. Therefore the cured protective layer which is free of impurities can be formed. If an acid or salt catalyst is added to the hydrolysis system even in a small amount, the catalyst acts on the photoreceptor and deteriorates it at the time of heat-curing or during actual long use of the photoreceptor. In the present invention, in order to form the protective layer using the product of uncatalized hydrolysis of the silane compounds, three kinds of silane compounds as mentioned above are mixed in certain proportions, and therefore the silane compounds are stoichemically condensed with dehydration simultaneously with the hydrolysis, to form a polymer layer in which silicon and oxygen atoms are firmly covalently bonded. In the present invention, therefore, the mix proportion of the silane compounds for forming the protective layer is the key to the success of forming a strong cured layer. This is what is distinguished from the method of forming electrophotographic photoreceptors using silane compounds which have already known in patents. The protective layer formed in the present invention has the thickness of from 0.1 to 2 μm.

The photoconductive layer provided with the protective layer according to the present invention is free from wear due to friction with paper and cleaning members and keeps high resolving power. In addition, it is sufficiently proof against continuous copying under conditions of high temperature and high humidity. Therefore, the protective layer according to the present invention is very useful for use in photoreceptors.

The present invention is explained more specifically with reference to examples but it is understood that the present invention is not limited to the following examples. All parts are by volume unless otherwise indicated.

EXAMPLE 1

2.4 parts of β-(3,4-epoxycyclohexyl)ethyltrimethoxysilane, 4.8 parts monomethyltrimethoxysilane, and 2.4 parts of γ-aminopropyltriethoxysilane were mixed. To the mixture 1.2 parts of water was added. The mixture was stirred vigorously at room temperature to allow hydrolysis to proceed. 50 parts of ethanol is then added to prepare a coating solution for forming a protective layer. Thereafter, the coating solution was applied to a conventional electrophotographic photoreceptor comprising an aluminum support provided with a selenium-deposited layer thereon and cured at 50° C. for 4 hours. A transparent, wear-resistant protective layer was formed. The protective layer was 0.8 μm thick. The bond strength of the protective layer to the photoreceptor was tested by peel test using a cellophane tape, with no part being peeled. The hardness of the protective layer was measured by the pencil hardness method and found to be a grade of 8H. The photoreceptor with the protective layer was applied to the electrophotographic process consisting of the steps of charge, exposure, development, transfer, and clean, and provided copies with good image quality without decrease in sensitivity and irregular images after copying 120,000 sheets of papers. Also, the surface of the photoreceptor maintained its initial glossiness and had no observed mars. In contrast to the photoreceptor of this Example, with the conventional photoreceptor without the protective layer, white lines and black lines appeared after copying 60,000 sheets of papers.

EXAMPLE 2

4.6 parts of γ-glycidoxypropyltriethoxysilane, 3.2 parts of dimethyldimethoxysilane, 4.8 parts of N-β-(aminoethyl)-γ-aminopropyltrimethoxysylane, and 1.2 parts of water were mixed at room temperature, to carry out a hydrolyzing reaction. After completion of the reaction, 150 parts of methanol was added to the mixture, to form a coating solution for forming a protective layer. The coating solution thus prepared was applied to a known electrophotographic photoreceptor comprising an aluminum support provided thereon with a selenium deposit and heated at 50° C. for 24 hours, to form a transparent, wear-resistant protective layer. The thickness of the protective layer was 0.4 μm. The bond strength of the protective layer to the photoreceptor was tested in the same manner as in Example 1. There was no peeled part. The hardness of the protective layer was measured by the pencil hardness method to be a grade of 7H. The photoreceptor with the protective layer was applied to the same electrographic process as in Example 1. After copying 120,000 sheets of papers, there were no decrease in sensitivity and irregular images, and the copies with high image quality can be obtained. Also, the surface of the photoreceptor maintained its initial glossiness and had no observed mars.

EXAMPLE 3

5.2 parts of γ-glycidoxypropyltrimethoxysilane, 6.4 parts of dimethyldimethoxysilane, 2.4 parts of N-β-(aminoethyl)-γ-aminopropyltrimethoxysilane, and 2.8 parts of water were mixed at room temperature. After thorough hydrolysis of the mixture, 120 parts of n-butanol was added to prepare a coating solution for forming a protective layer.

The coating solution thus prepared was applied to an electrophotographic photoreceptor provided thereon with a selenium deposit, and heated at 60° C. for 30 min to form a transparent, wear-resistant protective layer. The thickness of the protective layer was 0.7 μm.

The photoreceptor with the protective layer was tested in the same manner as in Example 1, and the same results as in Example 1 were obtained.

EXAMPLE 4

4.2 parts of β-(3,4-epoxycyclohexyl)ethyltrimethoxysilane 3.8 parts of dimethylmethoxysilane, 4.4 parts of γ-aminopropyltriethoxysilane, and 2.2 parts of water were mixed at room temperature. After thorough hydrolysis of the mixture, 100 parts of ethanol was added to prepare a coating solution for preparing a protective layer.

The coating solution thus prepared was applied to an electrophotographic photoreceptor comprising an aluminum support provided thereon with a selenium deposit, and heated at 50° C. for one hour to form a transparent, wear-resistant protective layer. The thickness of the protective layer was 0.6 μm.

The photoreceptor with the protective layer was tested in the same manner as in Example 1, and the same results as in Example 1 were obtained.

EXAMPLE 5

5.8 parts of γ-glycidoxypropyltrimethoxysilane, 1.2 parts of tetramethoxysilane, 4.6 parts of γ-aminopropylmethyldimethoxysilane, and 3.8 parts of water were mixed at room temperature. After thorough hydrolysis of the mixture, 150 parts of methanol is added to form a coating solution for forming a protective layer.

The coating solution thus prepared was applied to an electrophotographic photoreceptor comprising an aluminum support provided thereon with a selenium deposit, and heated at 60° C. for one hour. The thickness of the protective layer was 0.3 μm.

The photoreceptor with the protective layer was tested in the same manner as in Example 1 and the same results as in Example 1 were obtained.

EXAMPLE 6

2.6 parts of β-(3,4-epoxycyclohexyl)ethyltrimethoxysilane, 4.8 parts of trimethylmethoxysilane, 2.8 parts of aminomethyltrimethoxysilane, and 4.2 parts of water were mixed at room temperature. After thorough hydrolyzing reaction of the mixture, 80 parts of n-propyl alcohol was added to prepare a coating solution for forming a protective layer.

The coating solution thus prepared was applied to an electrophotographic photoreceptor comprising an aluminum support provided thereon with a selenium deposit, and heated at 60° C. for 30 min to form a transparent, wear-resistant protective layer. The thickness of the protective layer was 1.2 μm.

The photoreceptor with the protective layer was tested in the same manner as in Example 1, and the same results as in Example 1 were obtained.

EXAMPLE 7

To a mixture of 6.4 parts of β-(3,4-epoxycyclohexyl-)ethyltrimethoxysilane, 8.6 parts of monomethyltrimethoxysilane, and 5.8 parts of γ-aminopropyltriethoxysilane, 2.4 parts of water was added at room temperature to carry out a hydrolysis. Then 200 parts of ethanol was added to prepare a coating solution for forming a protective layer. The coating solution thus prepared was applied to an electrophotographic photoreceptor comprising an aluminum support provided thereon an organic photosensitive layer consisting of a charge-generating layer using chlorodiane blue and a charge-transfer layer using poly(N-vinylcarbazole), and heated at 80° C. for one hour to form a transparent, wear-resistant protective layer.

The thickness of the protective layer was 1.0 μm. The bond strength of the protective layer to the photoreceptor was tested by the pencil hardness method to be a grade of 8H.

The photoreceptor with the protective layer was applied to an electrophotographic process consisting of the steps of charge, exposure, development, transfer, and clean. Even after copying 80,000 sheets of papers, the photoreceptor provided copies with good image quality without decrease in sensitivity and irregular images. Also, the surface photoreceptor maintained its initial glossiness and had no observed mars. In contrast to the photoreceptor of this Example, with the photoreceptor without the protective layer, the thickness of the photosensitive layer decreased by 3 μm and the charging performance deteriorates after copying only 40,000 sheets of papers.

EXAMPLE 8

To a mixture of 4.6 parts of γ-glycidoxyethylpropyldiethoxysilane, 2.4 parts of monomethyltrimethoxysilane, and 4.2 parts of aminoethyltriethoxysilane 4.2 parts of water was added at room temperature to carry out a hydrolyzing reaction. Then 150 parts of ethanol was added to prepare a coating solution for forming a protective layer. The coating solution thus prepared was applied to an amorphous silicon photoconductive layer provided on an aluminum support, and heated at 80° C. for one hour to form a protective layer 0.5 μm thick. The resulting photoreceptor was applied to a known electrophotography. With the photoreceptor of this Example copies of good image quality without irregular images such as undesirable spread of image under conditions of 35° C. and 80% RH even after copying 100,000 sheets of paper. In contrast to this, with the conventional amorphous silicon photoreceptor without the protective layer, the undesirable spread of image ocurred under conditions of 35° C. and 80% RH after copying 50,000 sheets of papers.

In the above-described examples, the protective layer according to the present invention has been explained in connection with selenium, the organic photosensitive layer and the amorphous silicon photosensitive layer but it can be applied to other photoconductive layers.

What is claimed is:

1. An electrophotographic photoreceptor comprising an electrically conductive support, a photoconductive layer provided thereon, and a protective layer coated on the photoconductive layer, wherein the protective layer comprises a product of uncatalyzed hydrolysis of a composition essentially consisting of:

a. at least one epoxysilane compound selected from the group consisting of the compounds of group A;
b. at least one alkylalkoxysilane compound selected from the following group B; and
c. at least one aminosilane compound selected from the group consisting of the compounds of group C.

Group A;

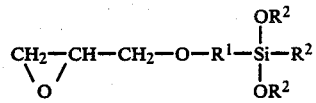

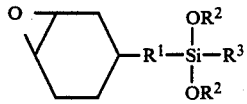

Group B; $(R^4)_nSi(OR^4)_{4-n}$

Group C;

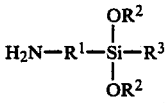

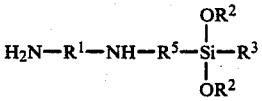

wherein $R^1$ is a straight-chain or branched alkyl group having up to 6 carbon atoms or $-CH_2CH{=}CH{=}CH_2CH_2-$, $R^2$ a straight-chain or branched alkyl group having up to 4 carbon atoms, $R^3$ is a straight chain or branched alkyl group having up to 4 carbon atoms or $OR^{3'}$, $R^{3'}$ is a straight-chain or branched alkyl group having up to 4 carbon atoms, $R^4$ is a straight-chain or branched alkyl group having up to 8 carbon atoms, $R^5$ is a straight-chain or branched alkyl group having from 2 to 4 carbon atoms, and n is an integer of up to 3.

2. The electrophotographic photoreceptor according to claim 1, wherein the protective layer comprises a product of uncatalized hydrolysis of a composition consisting of from 2 to 10 parts by volume of at least one epoxysilane compound of group A, from 2 to 10 parts by volume of at least one epoxysilane compound of group B, from 2 to 10 parts by volume of at least one aminosilane compound of group C, and from 1 to 6 parts by volume of water.

3. The electrophotographic photoreceptor according to claim 1, wherein group A is selected from the group consisting of γ-glycidoxypropyl-trimethoxysilane, γ-glycidoxypropyltriethoxysilane, β-(3,4-epoxycyclohexyl)ethyltrimethoxysilane and γ-glycidoxyethylpropyldiethoxysilane.

4. The electrophotographic photoreceptor according to claim 1, wherein B is selected from the group consisting of monomethyltrimethoxysilane, dimethyldimethoxysilane, and trimethyltrimethoxysilane.

5. The electrophotographic photoreceptor according to claim 1, wherein group C is selected from the group consisting of aminomethyltrimethoxysilane, aminoethyltriethoxysilane, γ-aminopropyltriethoxysilane, N-β-(aminoethyl) γ-aminopropyltrimethoxysilane, and N-β-(aminoethyl) γ-aminopropylmethyldimethoxysilane.

* * * * *